US005782467A

United States Patent [19]

Johnson

[11] Patent Number: 5,782,467

[45] Date of Patent: Jul. 21, 1998

[54] STAPLING FOR MULTIPLE BIN OUTPUT STATION

[75] Inventor: Steven M. Johnson, Eagle, Id.

[73] Assignee: Hewlett-Packard Company, Palo Alto, Calif.

[21] Appl. No.: 780,556

[22] Filed: Jan. 8, 1997

[51] Int. Cl.[6] ..... B65H 39/02

[52] U.S. Cl. ..... 270/58.13; 270/58.14; 270/58.18

[58] Field of Search ..... 270/58.08, 58.11, 270/58.13, 58.14, 58.18

[56] References Cited

U.S. PATENT DOCUMENTS

| | | | |
|---|---|---|---|
| 4,822,016 | 4/1989 | Sakuuchi et al. | 270/58.18 |
| 4,971,302 | 11/1990 | Morii et al. | 270/58.14 |
| 5,255,902 | 10/1993 | Coombs | 270/58.14 |
| 5,362,200 | 11/1994 | Ushirogata | 270/58.14 X |
| 5,531,437 | 7/1996 | Coombs | 270/58.13 X |
| 5,634,630 | 6/1997 | Jung | 270/58.14 |

*Primary Examiner*—Hoang Nguyen

[57] ABSTRACT

An electric stapler (11) is carried on a transport mechanism (27) for an output bin selector of a sheet media handling apparatus such as a printer having multiple output bins (17). The stapler (11) is established in alignment with an output bin associated with the diverter (29), so that a movement of the diverter (29) to one of the output bins (17) also effects a corresponding movement of the stapler (11) to the same output bin. This permits print jobs which are directed to specific output bins (17) to be selectively stapled.

17 Claims, 2 Drawing Sheets

STAPLING FOR MULTIPLE BIN OUTPUT STATION

FIELD OF THE INVENTION

This invention relates to paper handling and stapling. More particularly, the invention relates to stapling of paper or other sheet media at multiple output stations of a paper handler.

BACKGROUND OF THE INVENTION

This invention was developed as a result of a desire to provide improved automatic stapling of multiple paper sheets. The multiple paper sheets are provided as a result of operation of a paper handling machine such as an electrophotographic printer. The paper handling machine typically causes the paper to pass through a first process, such as printing, after which the paper is discharged to an output station. In many instances it is convenient to have the printer or other paper handling machine staple multiple sheets together. Of particular interest are output stations which have multiple bins which may be used for sorting purposes. In addition, it is desired to provide an ability to staple individual ones of multiple documents without a necessity to move earlier documents prior to stapling a subsequent document.

While the invention can be used in a wide variety of applications, including staplers which are not associated with a larger paper handling machine, it will be described in connection with an electrophotographic printer. The printer has a "mail boxing output device," which allows the printer's output to be sorted by categories. In some cases the mail boxing is sufficient to separate print jobs. In other instances, it is advantageous to provide the option of stapling print jobs, with a stapled print job being one of the printer output options.

It is possible to align the stapler with only one bin. If the stapler were associated with only one bin, the user would have a choice of either selecting from one of several bins or having the print job stapled and only discharged to a first bin. One prior art arrangement for a multiple bin stapler is used with a photocopy machine, in which a stapler is caused to travel vertically to each of several bins. Subsequent to a copy and sort job, the stapler travels to each loaded bin and staples the assembled sheets of paper. This configuration requires a separate transport mechanism for the stapler. As a matter of convention, the direction of movement and of the stapler and relative positions of the several bins are considered to be "upward" and "downward." It is understood, however, that these references of "upward" and "downward" are at variance with the vertical by the angle of the bins. The invention is not directly dependent on the horizontal reference plane, so that the angle of variation can be up to 360 °.

When used as a network printer, the mail boxing output device can be controlled by printer control commands from individual computers, as well as by programming the printer to recognize addresses of network printers and sorting accordingly. Such print jobs are often performed with the printer unattended. Therefore, the various bins are not normally emptied prior to a subsequent print command.

It would be desired to have a multiple bin output device operate in a manner which permits the stapling function in each bin to be controlled separately. It is also desired to provide an output stapler which does not require a separate transport mechanism for the stapling operation. It is also desired to control a position of a stapling mechanism in accordance with bin control commands for independent print jobs.

SUMMARY OF THE INVENTION

In accordance with the present invention, an electric stapler is provided on a sheet media or paper handling machine having multiple output bins. The paper machine has an output selection in which a movable mechanism directs the sheet media to selected ones of the bins. The movable output mechanism also serves to effect a shift in a position of the stapler, so that a mechanical selection of an output bin for depositing sheet media also results in a mechanical selection of an output bin for stapler alignment.

In accordance with a preferred embodiment, a moveable sheet media diverter is used to select one of a plurality of output bins. The moveable diverter is on a transport mechanism which also carries the stapler, so that a positioning of the diverter to a particular output tray also results in a positioning of the stapler to the same output tray. This eliminates a need for providing a separate transport mechanism for the stapler and the paper diverter.

In accordance with a further aspect of the invention, a multiple bin output device is operated in conjunction with a printer and includes a capability of executing a staple command. The stapler is maintained in alignment with a tray-loading mechanism, so that a staple command is automatically effected on that bin to which the associated sheet of media was discharged.

In accordance with a further aspect of the invention, printer is provided with a plurality of output bins and discharges sheet media to selected bins such that multiple sheets are discharged to a selected bin prior to a duplicate copies being discharged to another selected bin. A stapler is carried to the bin to which the multiple sheets are being discharged, which results in the multiple sheets being discharged into a position of registration with the stapler. The stapler is then moved into the registration position if required, and the multiple sheets are stapled. Subsequent copies discharged into individual bins are then able to be stapled in a similar manner.

The invention is particularly useful for computer-operated printers, but can be used with a wide variety of sheet media handling operations.

DETAILED DESCRIPTION OF THE INVENTION

Figure 1:
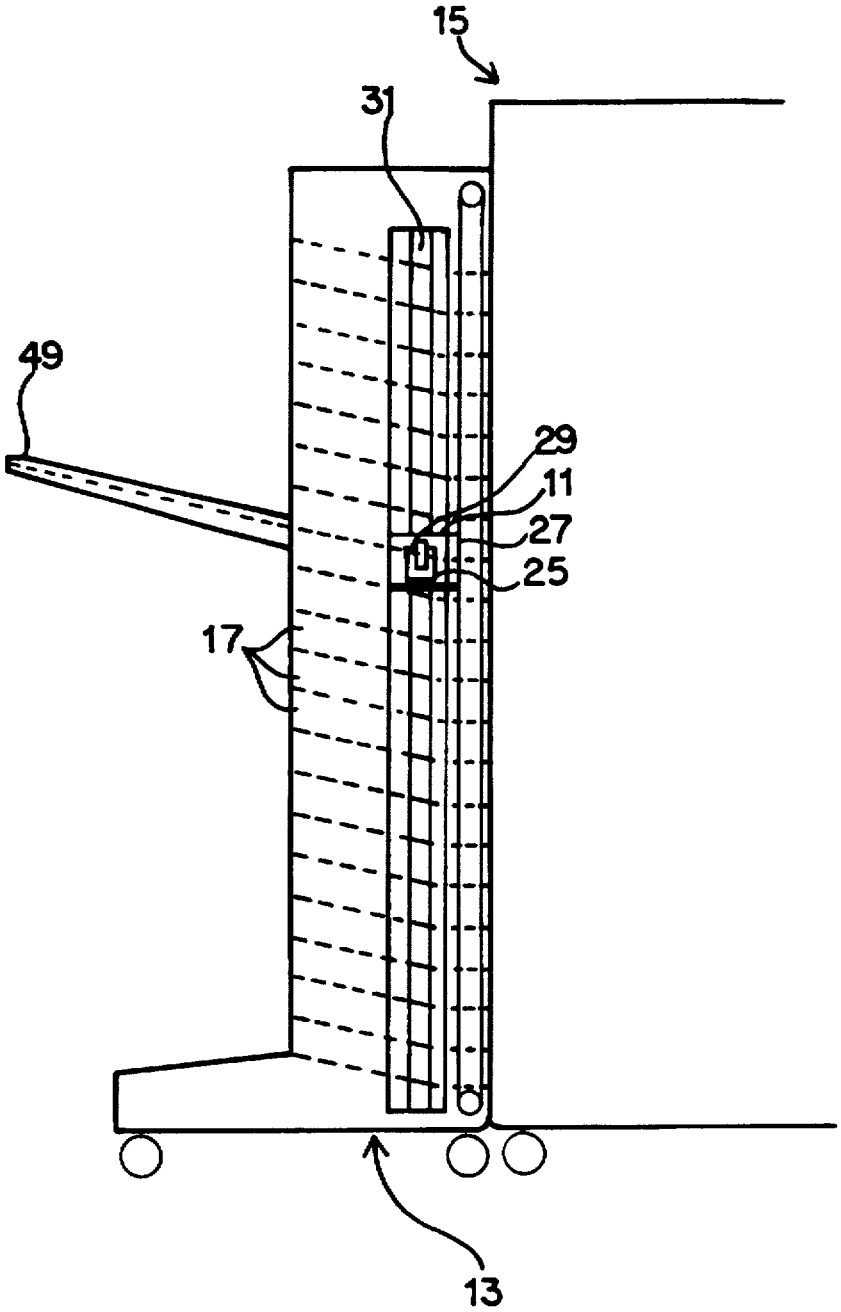
FIG. 1 shows an output section of a printer, in which a stapler is provided, as in the preferred embodiment of the invention.

A stapler 11 is used in an output sorter 13 of a printer 15 as shown in FIG. 1. The output sorter 13 has multiple output bins or trays 17. Sheet media, typically paper which is processed by the printer, is selectively discharged into the different output trays 17. This configuration permits the printer to have a "mailbox" output, whereby printed sheets are selectively placed in different slots.

Figure 2:
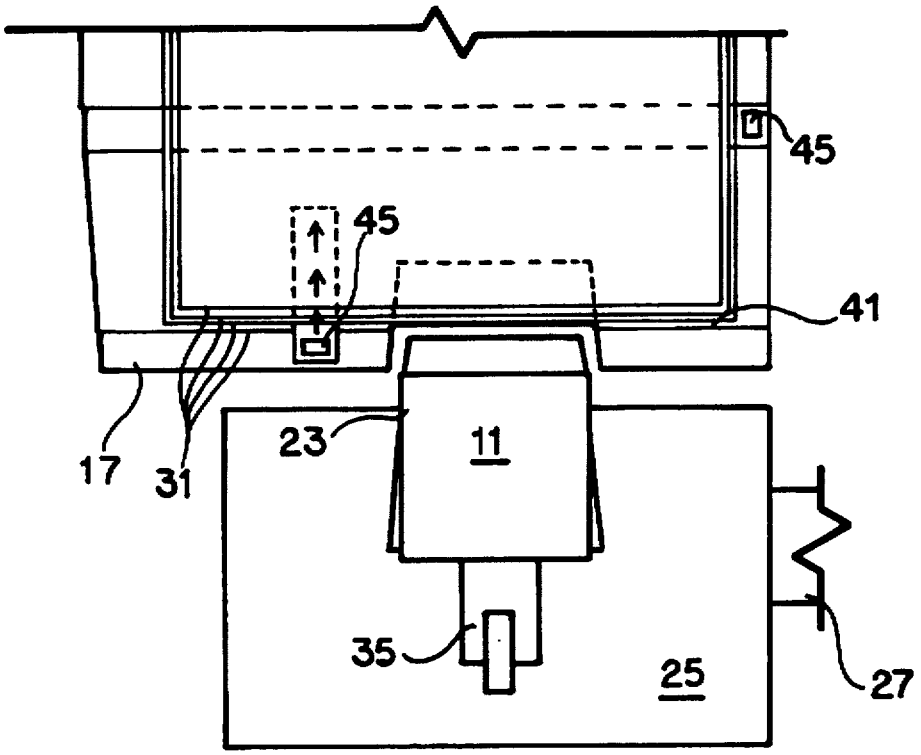
FIG. 2 shows details in a top view of an output bin and stapling mechanism of FIG. 1.

The inventive stapler forms a part of the output sorter 13. The stapler consists of body 23 (shown in FIG. 2) which is mounted to a stapler carrier 25. The stapler carrier 25 is carried by an output selection transport mechanism 27, which also carries a bin diverter 29. The output transport mechanism 27 moves vertically in order to align the diverter 29 with a selected one of the trays 17.

When the stapler 11 is not being operated (i.e., not stapling), the stapler carrier 25 is in a rest position. The rest position positions the stapler 11 out of registration with an edge of the sheet media 31. The stapler 11 is nevertheless at an approximate alignment with the sheet media 31 at whichever output bin 17 the diverter is positioned. This is accomplished by using the output transport mechanism to vertically move the staple carrier. The approximate alignment permits the stapler 11 to be placed into registration with the sheet media 31 in the cognizant bin 17, by further movement of the stapler carrier 25. In order to effect a staple operation, the stapler 11 is moved into registration with the sheet media 31 by a stapler position actuator 35. The actuator 35 moves the stapler carrier 25 into registration with the sheet media 31. When the stapler 11 is in registration with the sheet media 31, the stapler 11 is actuated, causing the stapler 11 to staple the sheet media 31. The actuator 35 then moves the stapler carrier 25 out of registration with the sheet media 31. When the stapler carrier 25 is out of registration with the sheet media 31, the transport mechanism 27 can be moved to another output tray 17, as desired.

Each output tray 17 is set at an angle from horizontal. The angle is such that sheet media 31 discharged into the output tray 17 by the diverter 29 falls into registration with an edge guide 41 on each output tray 17. A finger 45 on each output tray 17 moves the sheet media 31 out of registration with the edge guide 41 after the completion of each print job. The finger 45 is configured so that at the completion of actuation of the finger 45, the sheet media 31 in the output tray 17 is held down and away from registration with the edge guide 41 and additional sheet media may be discharged into the output tray 17 without engaging the finger 45. The additional sheet media would remain in registration with the edge guide 41, thereby permitting the additional sheet media to be stapled without re-stapling the sheet media under the finger 45.

Advantageously, when used with a laser printer such as the assignee's HP LaserJet printer, sheets are printed individually, regardless of number of copies. Therefore, a typical print job consisting of multiple sheet media 31 can be expected to be discharged through the diverter 29 while the diverter 29 remains at the position of one output tray 17. This can be accomplished despite multiple copies of the print job being printed. This is possible because the image is processed electronically, rather than directly from a hard copy original. This makes it easier to separates previous sequences of sheet media discharge from a present sheet media discharge. An example of separation of a previous sequences of sheet media discharge from a present sheet media discharge would be separation of a previous print job from print job to be stapled.

What has been described is a specific configuration of the preferred embodiment of the invention. It is possible to implement the invention in a wide variety of ways. For example, it is possible to use a different mechanism for moving the sheet media out of registration with the stapler 11, for example, by moving the sheet media 31 to output chutes 49 which form extensions of the output trays 17 or may be separate parts. By moving the sheet media 31 to such output chutes 49, the sheet media 31 is moved from an initial position in the output tray 17, permitting a staple operation to take place at said initial position while missing sheet media moved away from the initial position. It is also possible to provide other arrangements whereby the output stapler 11 is maintained in alignment with a paper discharge path from the printer.

Alternatively, the sheet media in the trays 17 can be separated vertically. This can be accomplished by providing a separation guide which separates previous print jobs from a present print job so that only a current print job will be in registration with the stapler 11. The separation can be accomplished by bringing the stapler 11 into a registration position prior to feeding the sheet media 31 into an output tray 17. At the termination of discharge of sheet media 31 in a particular print job, the stapler 11 is taken out of registration and the sheet media 31 is allowed to drop, within the output tray 17 below the registration position.

In operation, the printer 15 discharges sheet media 31 which is transferred by the output transport mechanism 27. The output transport mechanism 27 moves vertically in order to align the diverter 29 with a selected one of the trays 17. The diverter 29 falls into registration with the tray 17. The edge guide 41 permits the sheet media 31 to be stapled with other sheet media which is in registration with the edge guide at that time. The stapler 11, which is carried by the transport mechanism 27 is placed into its alignment at the selected output bin 17. This is done prior to feeding the sheet media 31 into the selected output bin 17. The movement of the stapler 11 out of registration with the sheet media 31 permits the transport mechanism 27 to move the stapler (11) to different ones of the output bins 17 without engaging sheet media previously discharged to the output bins 17.

While the preferred embodiment is directed to a stapler 11 used in the output mechanism of a printer, it is possible to use the inventive concepts in other applications. The invention can be used on electrophotographic copiers. It is possible to use the inventive techniques to process sheet media on sheet media handling machines other than printers. Accordingly, the invention should be read as limited in scope by the claims.

What is claimed is:

1. An output mechanism for sheet media handling equipment, comprising:

a. a plurality of output bins;

b. a diverter mechanism for accepting sheet media which have been processed by the sheet media handling equipment and directing the sheet media to a selected one of the output bins;

c. a transport mechanism for shifting the diverter mechanism to said selected output bin;

d. a stapler carried by the transport mechanism; and e. a mechanism for moving the stapler and the sheet media out of registration with one another, thereby permitting the transport mechanism to move the stapler to different ones of the output bins.

2. The output mechanism of claim 1, comprising:

the mechanism for moving the stapler and the sheet media out of registration including a stapler position actuator for moving the stapler into registration with the sheet media at least during a staple operation.

3. The output mechanism of claim 1, comprising:

the mechanism for moving the stapler and the sheet media out of registration including a paper displacement mechanism for moving the sheet media away from an initial position in the selected output bin, permitting a staple operation to take place at said initial position while missing sheet media moved away from the initial position.

4. The output mechanism of claim 3, comprising:

the paper displacement mechanism including a finger actuatable to result in the sheet media in the output tray held down and away from registration with an edge guide, thereby separating previous sequences of sheet media discharge from a present sheet media discharge.

5. The output mechanism of claim 4, comprising:

the paper vertical separation guide including components of the stapler, so that movement of the stapler controls the vertical separation guide.

6. The output mechanism of claim 3, comprising:

paper displacement mechanism causing the sheet media to drop, within the output bin, away from said initial position.

7. The output mechanism of claim 1, comprising:

the mechanism for moving the stapler and the sheet media out of registration including a stapler position actuator for moving the stapler into registration with the sheet media at least during a staple operation.

8. The output mechanism of claim 1, wherein:

a mechanism for moving the stapler and the sheet media out of registration with one another brings the stapler into a registration position prior to feeding the sheet media into one of said output bins, and at a termination of discharge of the sheet media in a print job, moving the stapler out of said registration position, and thereby permitting the transport mechanism to move the stapler to different ones of the output bins without engaging sheet media previously discharged to the output bins.

9. A method for stapling sheet media on sheet media handling equipment having a plurality of output bins, comprising:

a. selecting one of said output bins;

b. aligning a diverter mechanism to said output;

c. using the diverter mechanism to direct sheet media which have been processed by the sheet media handling equipment to said output bin;

d. moving a stapler to align with said output bin;

e. performing a staple operation prior to aligning the diverter mechanism to another output bin; and f. moving the stapler and the sheet media out of registration with one another, thereby permitting movement of the stapler to different ones of the output bins.

10. The method of claim 9, comprising:

simultaneously aligning the diverter mechanism and the stapler with selected ones of the output bins.

11. The method of claim 9, comprising:

transporting the stapler with a selection mechanism for the diverter mechanism so as to simultaneously align the diverter mechanism and the stapler with selected ones of the output bins.

12. The method of claim 9, comprising:

moving the stapler and the sheet media out of registration by using a stapler position actuator.

13. The method of claim 9, comprising:

moving the stapler and the sheet media out of registration by moving the sheet media away from an initial position in the selected output bin, permitting a staple operation to take place at said initial position while missing sheet media moved away from the initial position.

14. The method of claim 13, comprising:

providing a finger actuatable to result in the sheet media in the output tray held down and away from registration with an edge guide, thereby separating previous sequences of sheet media discharge from a present sheet media discharge.

15. The method of claim 14, comprising:

using the stapler to separate previous sequences of sheet media discharge from a present sheet media discharge.

16. The method of claim 13, comprising:

causing the sheet media to drop, within the output bin, away from said initial position.

17. The method of claim 9, comprising:

moving the stapler and the sheet media out of registration with one another by bringing the stapler into a registration position prior to feeding the sheet media into said output bin, and at a termination of discharge of the sheet media in a print job, moving the stapler out of said registration position, and thereby permitting said movement of the stapler to different ones of the output bins without engaging sheet media previously discharged to the output bins.

* * * * *